US007376986B2

(12) United States Patent
Smith et al.

(10) Patent No.: US 7,376,986 B2
(45) Date of Patent: May 27, 2008

(54) COLLAPSIBLE BED FRAME

(75) Inventors: Bryan L. Smith, Kernersville, NC (US); Paulo Renato Zipperer, Sao Bento do Sul (BR); Frank Real, San Diego, CA (US)

(73) Assignee: Folding Bunk Properties (FBP), LLC, Kernersville, NC (US)

( * ) Notice: Subject to any disclaimer, the term of this patent is extended or adjusted under 35 U.S.C. 154(b) by 41 days.

(21) Appl. No.: 11/583,425

(22) Filed: Oct. 19, 2006

(65) Prior Publication Data

US 2008/0092289 A1 Apr. 24, 2008

(51) Int. Cl.
*A47C 19/20* (2006.01)

(52) U.S. Cl. ..... 5/9.1; 5/174; 5/176.1

(58) Field of Classification Search ..... 5/8, 5/9.1, 174, 176.1–180
See application file for complete search history.

(56) References Cited

U.S. PATENT DOCUMENTS 695,820 A * 3/1902 Loher ..... 5/9.1
1,093,774 A * 4/1914 Fagan ..... 5/176.1
1,195,637 A * 8/1916 Anderson ..... 5/9.1
1,389,697 A * 9/1921 Phipps ..... 5/9.1
3,381,319 A 5/1968 Breault
3,755,832 A 9/1973 Bennett
3,886,604 A * 6/1975 Ewing ..... 5/8
3,896,513 A 7/1975 Boucher et al.
D304,523 S 11/1989 Dillner et al.
6,817,046 B1 11/2004 Srour et al.
6,817,047 B2 11/2004 Brodeur
6,907,627 B2 6/2005 Waldman et al.
7,203,980 B2 * 4/2007 McBrayer et al. ..... 5/2.1

* cited by examiner

*Primary Examiner*—Michael Trettel
(74) *Attorney, Agent, or Firm*—C. Robert Rhodes, Esq.; Womble Carlyle Sandridge & Rice PLLC

(57) ABSTRACT

A collapsible bunk bed is provided having a first and second bed frame, one of which is positioned vertically above the other to form the bunk bed. The end walls of each bed frame have a hinged joint in the central portion so that the bunk bed may be folded into a collapsed configuration without disassembly of the end walls and side rails.

5 Claims, 7 Drawing Sheets

COLLAPSIBLE BED FRAME

FIELD OF THE INVENTION

The present invention relates generally to bed frame constructions, and more particularly, to bunk beds having a folding/collapsible frame.

BACKGROUND OF THE INVENTION

Beds are conventionally constructed by interconnecting a pair of opposed end walls (commonly referred to as a footboard and a headboard) by means of a side member on either side (commonly called a "rail") that extends lengthwise between corresponding ends of the footboard and the headboard. Each rail typically has an inwardly extending flange upon which several slats are placed to support a box springs and/or mattress. The side rails may either be bolted to corner parts of the headboard and footboard at opposite ends of the rail or may have hooks for engaging with slots formed in the corner parts of the headboard and footboard. When purchased, the headboard, footboard, and side rails are separate and must be assembled into a completed bed frame. For storage or transport, the bed frame must be disassembled and carefully packaged so that the individual loose pieces are not damaged.

Bunk beds have long provided a means for economizing space by permitting the vertical stacking of twin-sized beds, thus reducing the "footprint" for the beds in half. Nonetheless, each of the beds must first be constructed in the same manner as a conventional bed and then stacked. Likewise, for storage, the beds must be unstacked, individually disassembled, and the parts packaged. This is both time consuming and requires the handling and careful storage of multiple parts.

Thus, whenever the beds are moved or stored, considerable time is spent, and there is opportunity for loss of parts. The problem is exacerbated in the use of rental furniture, because it is by nature moved many times.

SUMMARY OF THE INVENTION

The present invention is directed to a collapsible bunk bed that solves the problems with the assembly, disassembly, storage and shipping of bunk bed frames described above.

In one exemplary embodiment, the collapsible bunk bed comprises a first and second bed frame, one of which is stacked vertically atop the other to form the bunk bed. Each of the bed frames includes a pair of opposed end walls, each of which includes a wall portion with a corner member at each opposed end. A pair of opposed side members extend between each of the end walls, each side member fixedly connected at each end to corresponding corner members of the opposed end walls. The wall portion of each end wall is hingedly attached at each end to the corresponding corner member and is also hinged along a vertical seam in the central portion of the wall portion. Each side member also includes a mattress supporting flange along its lower portion upon which mattress supporting slats rest. One of the bed frames has the four corner members connected to and supported by the corresponding corner members of the bed frame underneath.

In one exemplary embodiment, the corner members of the first and second bed frames are integrally formed. A vertically extending connecting member interconnects the corresponding end walls of the first and second bed frames, each connecting member being formed of two parts hingedly connected along a seam therebetween coextensive to the vertical seam in the wall members. This connecting member insures that the end walls hinge at the same time, resulting in a smooth folding motion.

In another embodiment, the first and second bed frames are separable into individual beds by making the same corner posts capable of being separated.

In yet another exemplary embodiment, the upper bed frame is narrower, and therefore the end walls of the lower frame have an extended portion. In each case, the corner posts of one side of the upper bed frame will align with and be connected to an intermediate post on the lower bed frame.

The embodiments described above are exemplary only, and other aspects of the present invention will become apparent to those skilled in the art after a reading of the following description of the preferred embodiment in combination with the figures.

DESCRIPTION OF THE PREFERRED EMBODIMENT

Figure 1:
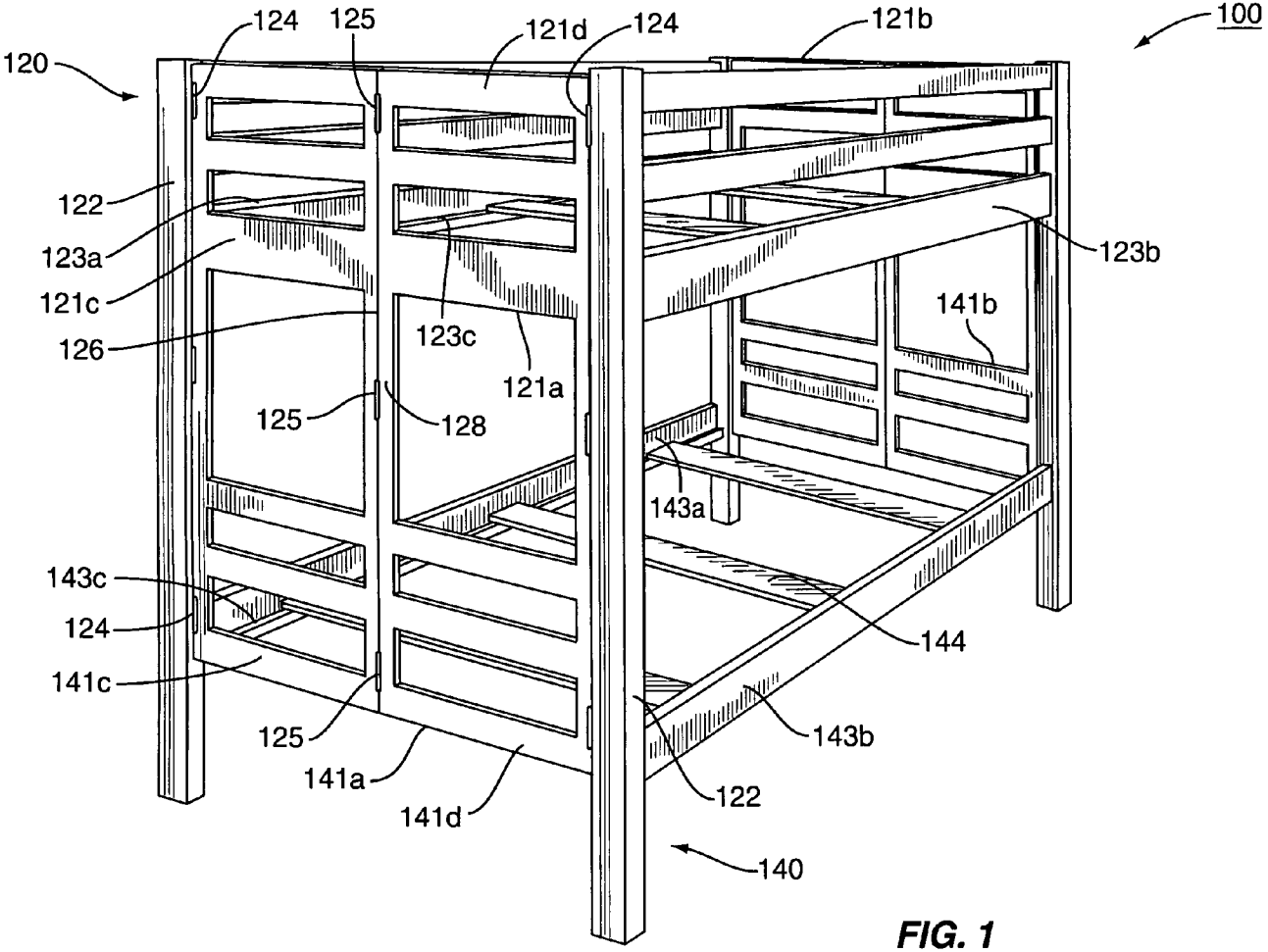
FIG. 1 is a side perspective view of one embodiment of the foldable bunk bed of the present invention.

Referring to the Figures in general, one aspect of the present invention is directed to a collapsible, or foldable, bunk bed. A first embodiment of the collapsible bunk bed 100 is shown in FIG. 1. The collapsible bunk bed 100 comprises first and second bed frames 120, 140, one of which is positioned vertically above the other to form the bunk bed. As shown in FIG. 1, in this embodiment, the first and second frames 120, 140 are integrally formed into a single unit such that the two frames are not separable. Each frame 120, 140 comprises a pair of opposed end walls 121*a*, 121*b* and 141*a*, 141*b*, each of which includes a wall portion with a corner member 122 at each opposed end. In the embodiment shown in FIG. 1, each corner member 122 extends as an integral member between the upper and lower bed frames 120, 140.

A pair of opposed side members 123*a*, 123*b* extend between walls 121*a* and 121*b*. Similarly, another pair of side members 143*a* and 143*b* extend between end walls 141*a* and 141*b*. Each of the opposed side members 123*a*, 123*b*, 143*a*, and 143*b* are fixedly connected at each end to corresponding corner members 122 of the opposed end walls 121*a*, 121*b*, 141*a*, 141*b*. As used herein, "fixedly connected" refers to either a permanent or removable connection between the opposed side members 123*a*, 123*b*, 143*a*, and 143*b* and the corresponding corner members 122, but not a hinged connection. The wall portion of each end wall 121*a*, 121*b*, 141*a*, 141*b* is hinged at each end to corresponding corner members 122 with hinges 124. As shown in FIG. 1, each of the opposed walls 121*a*, 121*b*, 141*a*, 141*b* comprises a pair of panels 121*c*, 121*d*, and 141*c*, 141*d* that are hingedly connected with hinges 125 along a vertical seam 126 in the central portion of the wall portion 121*a*, 121*b*, 141*a*, 141*b*. Each side member further includes an intumed supporting flange 123*c*, 143*c* along the lower portion thereof. For ease in simultaneously folding and unfolding the first and second bed frames 120, 140, a hinged connecting member 128 connects the end walls 121*a* to 141*a* and 121*b* to 141*b*. Optional removable slats 144 are preferably provided to support a mattress.

Figure 2:
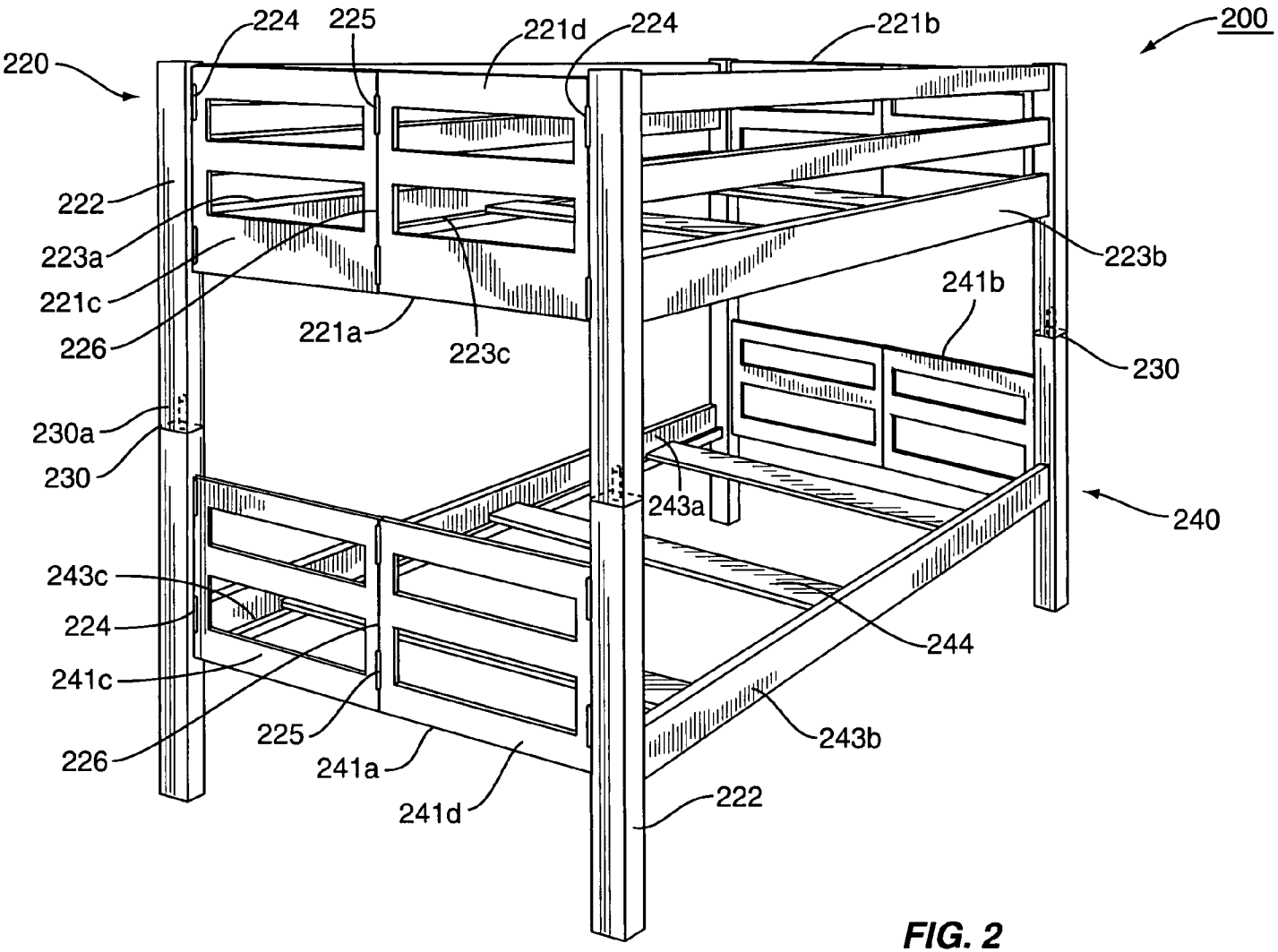
FIG. 2 is a side perspective view of an alternative embodiment of the foldable bunk bed of the present invention.

Turning now to FIG. 2, a second embodiment of the collapsible bunk bed is shown generally as 200. The collapsible bunk bed 200 also comprises first and second bed frames 220, 240 one of which is positioned vertically above the other to form the bunk bed. As shown in FIG. 2, in this embodiment, the first and second frames 220, 240 are separable into two individual bed frames at junction 230. Each frame 220, 240 also comprises a pair of opposed end walls 221*a*, 221*b* and 241*a*, 241*b* each of which include a wall portion with a corner member 222 at each opposed end. In this embodiment, pins, or dowels 230*a* are inserted into each of the corner members 222 at the top of the corner member 222 of the lower frame 240 or the bottom of the corner member 222 of the upper frame 220 to hold the two beds securely together.

A pair of opposed side members 223*a*, 223*b* extend between end walls 221*a* and 221*b*. Similarly, another pair of side members 243*a*, 243*b* extend between end walls 241*a* and 241*b*. Each of the opposed side member 223*a*, 223*b*, 243*a*, and 243*b* are fixedly connected at each end to corresponding corner members 222 of the opposed end walls 221*a*, 221*b*, 241*a*, and 241*b*. The wall portion of each end wall 221*a*, 221*b*, 241*a*, and 241*b* are again hinged at each end to the corresponding corner members 222 with hinges 224. As shown in FIG. 2, each of the opposed walls 221*a*, 221*b*, 241*a*, and 241*b* also comprise a pair of panels 221*c*, 221*d*, and 241*c*, 241*d* that are hingedly connected with hinges 225 along a vertical seam 226 in the central portion of the wall portion 221*a*, 221*b*, 241*a*, and 241*b*. Each side member further includes an inturned supporting flange 223*c*, 243*c* along the lower portion thereof. As will be appreciated, in this embodiment, the opposed walls 221, 241 of the first and second bed frames 220, 240 are not connected as in the first embodiment of FIG. 1. Again optional removable slats 224 may be provided to support a mattress.

Figure 3:
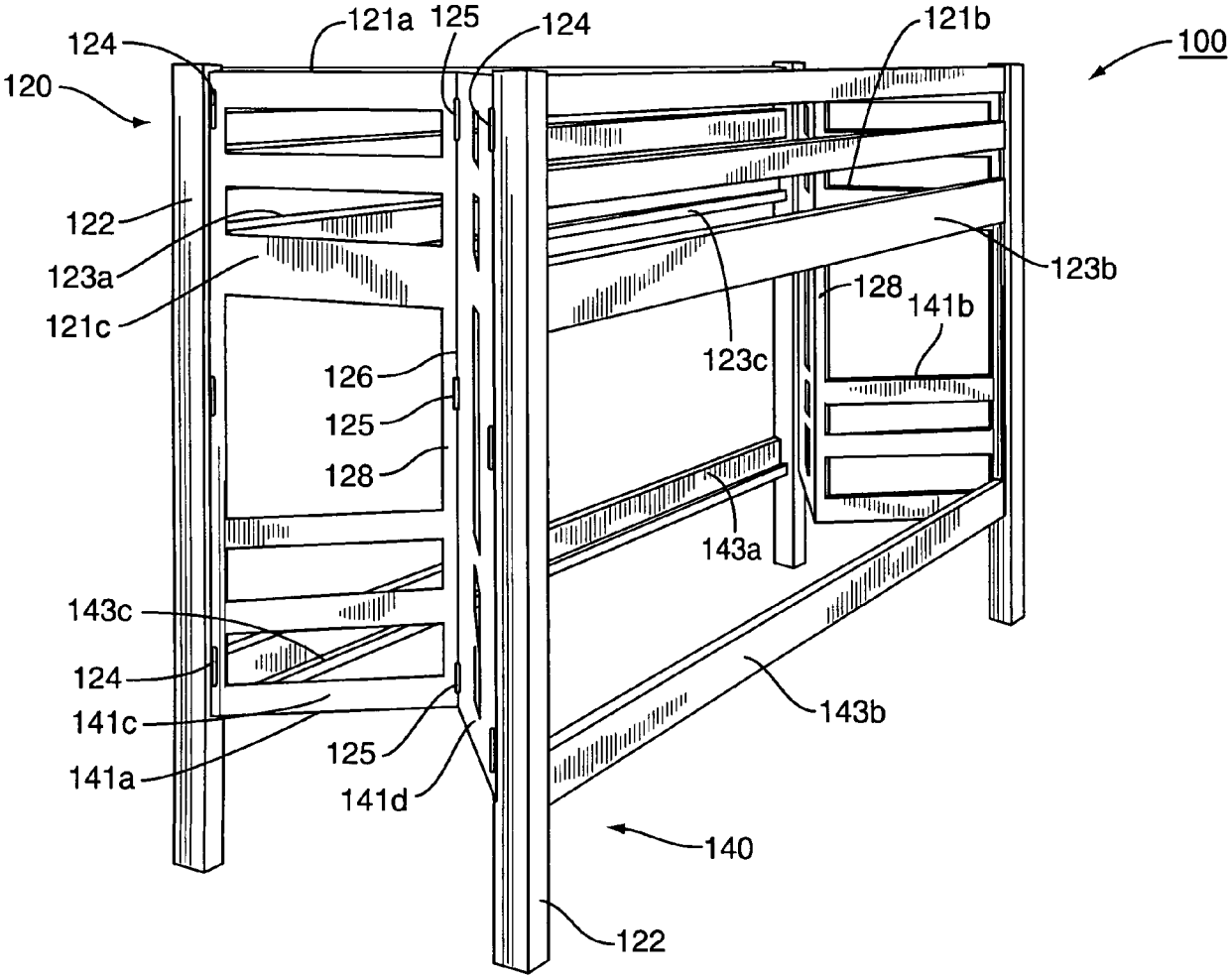
FIG. 3 is a side perspective view of the embodiment of FIG. 1 in a semi-folded position.
Figure 4:
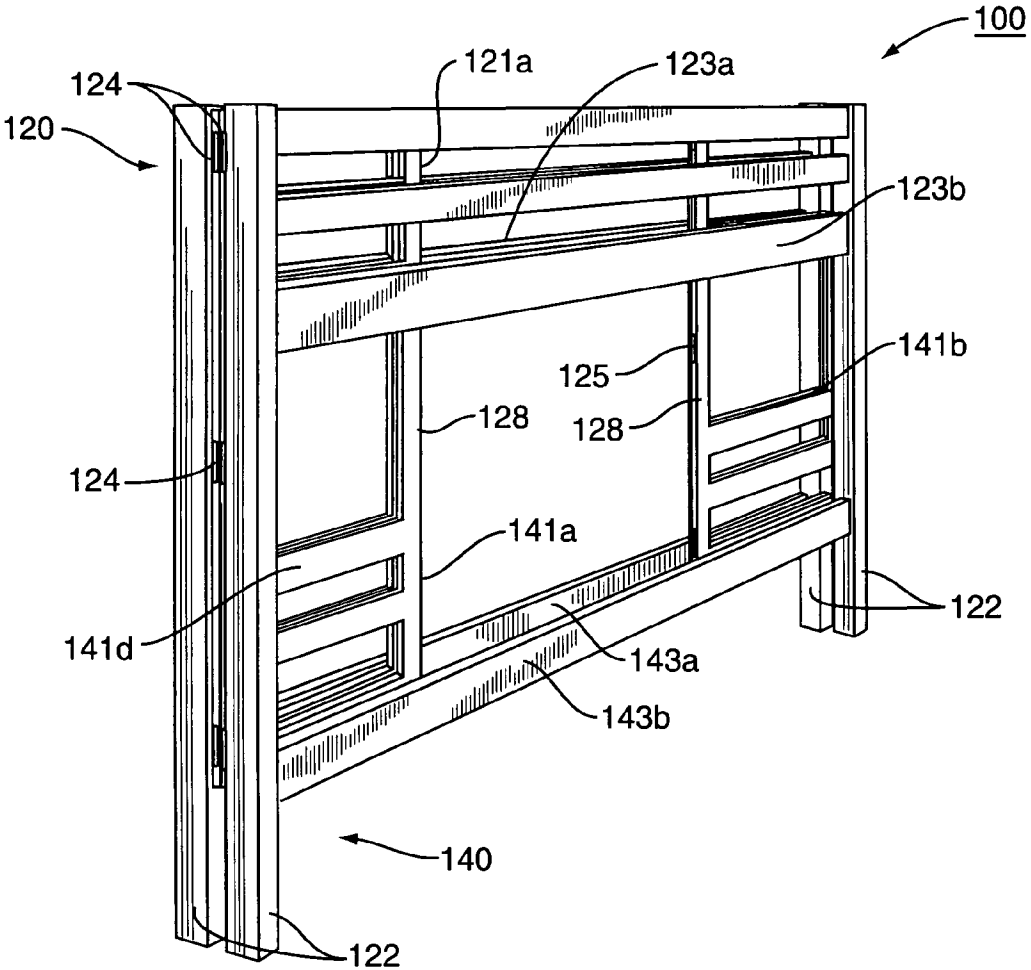
FIG. 4 is a side perspective view of the embodiment of FIG. 1 in a completely folded, storage position.

Turning now to FIGS. 3 and 4, the collapsible bunk bed 100 of FIG. 1 is shown in a semi-folded and completely folded configuration. As shown in the Figures, the opposed end walls 121*a*, 121*b*, 141*a*, and 141*b* fold inwardly to form a relatively flat, thin assembly for compact storage and/or transport of either of the types of bunk beds 100, 200.

Figure 5:
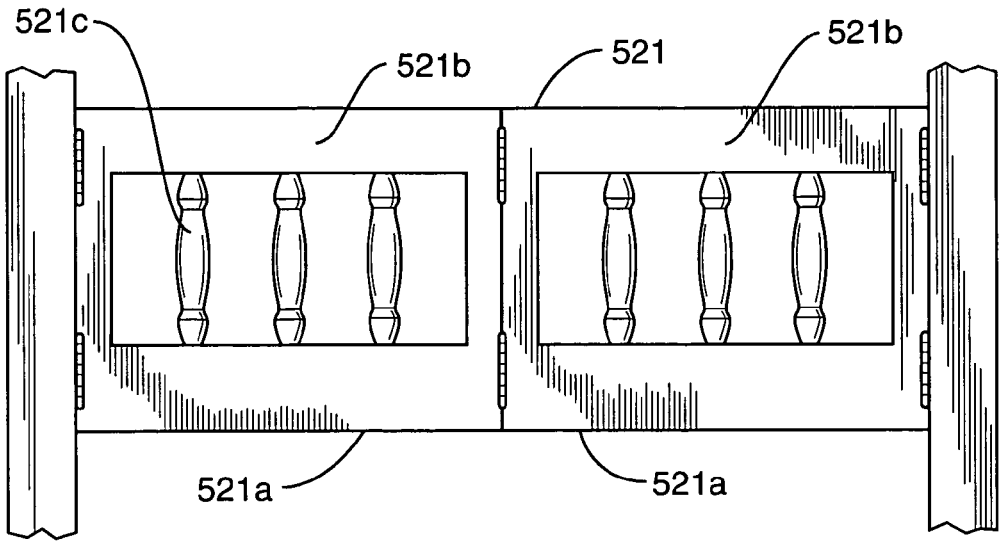
FIG. 5 is an elevational view of an exemplary alternative end wall for the foldable bed of the present invention.
Figure 6:
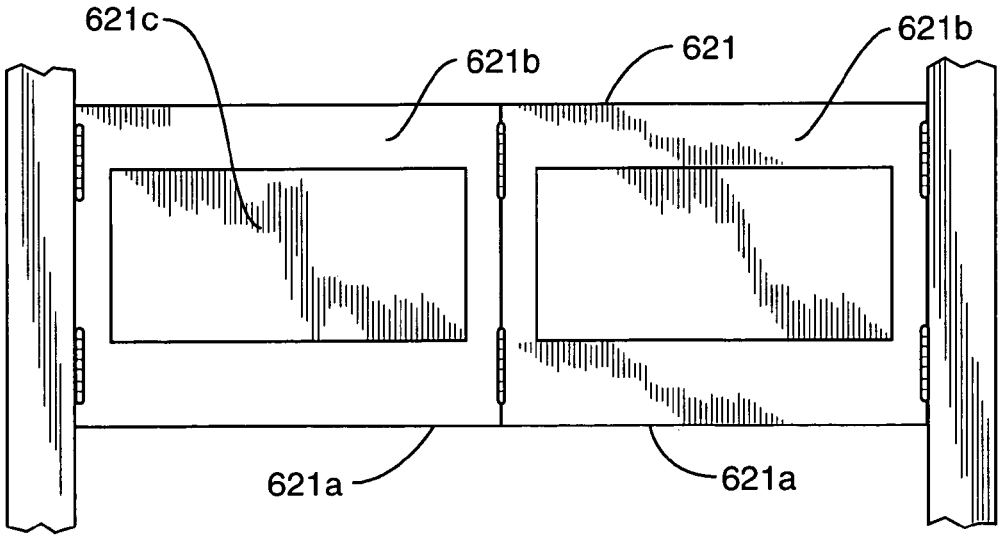
FIG. 6 is an elevational view of another exemplary end wall for the foldable bed of the present invention.

As will be appreciated by those skilled in the art, the materials of construction and actual design and ornamentation of the collapsible bunk bed frames are not critical to the present invention. Rather, as shown in FIGS. 5 and 6, the opposed end walls of the bed frame of the present invention may be formed and shaped in numerous ways. FIGS. 5 and 6 are exemplary of the various end wall configurations that are possible. For example, the end wall 521 of FIG. 5 comprises a pair of sections 521*a* having a frame, or border 521*b* having a plurality of posts 521*c* attached thereto. Alternately, as shown in FIG. 6, the end walls 621 may comprises solid sections 621*a*, each formed from one or more panels 621*b*, 621*c*.

Figure 7:
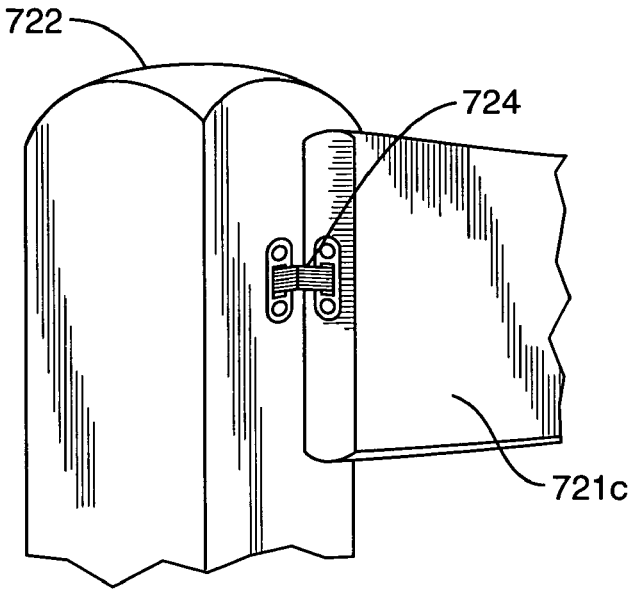
FIG. 7 is perspective view of an exemplary corner member hidden hinge connection.
Figure 8:
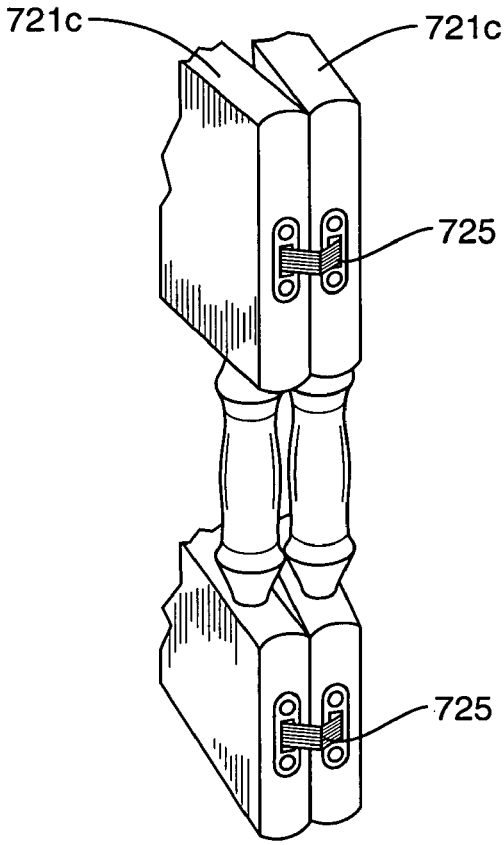
FIG. 8 is a perspective view of an exemplary end wall hidden hinge connection.

While the hinged connections between the corner and/or intermediate members and the sections end walls are illustrated in the embodiments of the bed frames shown in FIGS. 1,2 described above, and FIG. 9 described below, those skilled in the art will appreciate that other suitable hinge hardware may also be selected depending upon the desired aesthetic properties of the collapsible bed frame. For example, as shown in FIG. 7, the end wall sections 721*c*, 721*d* may be hingedly connected to a corner 722 or intermediate member with hidden, or concealed, hinges 724 which are commercially available in a variety of sizes and configurations. Such concealed hinges provide for an improved aesthetic appearance for the bed, giving the bed frame the appearance of a conventional bed frame and not a collapsible one. Similarly, as shown in FIG. 8, the end wall sections 721*c* and 721*d* may also be hingedly connected to one another with hidden hinges 725.

Figure 9:
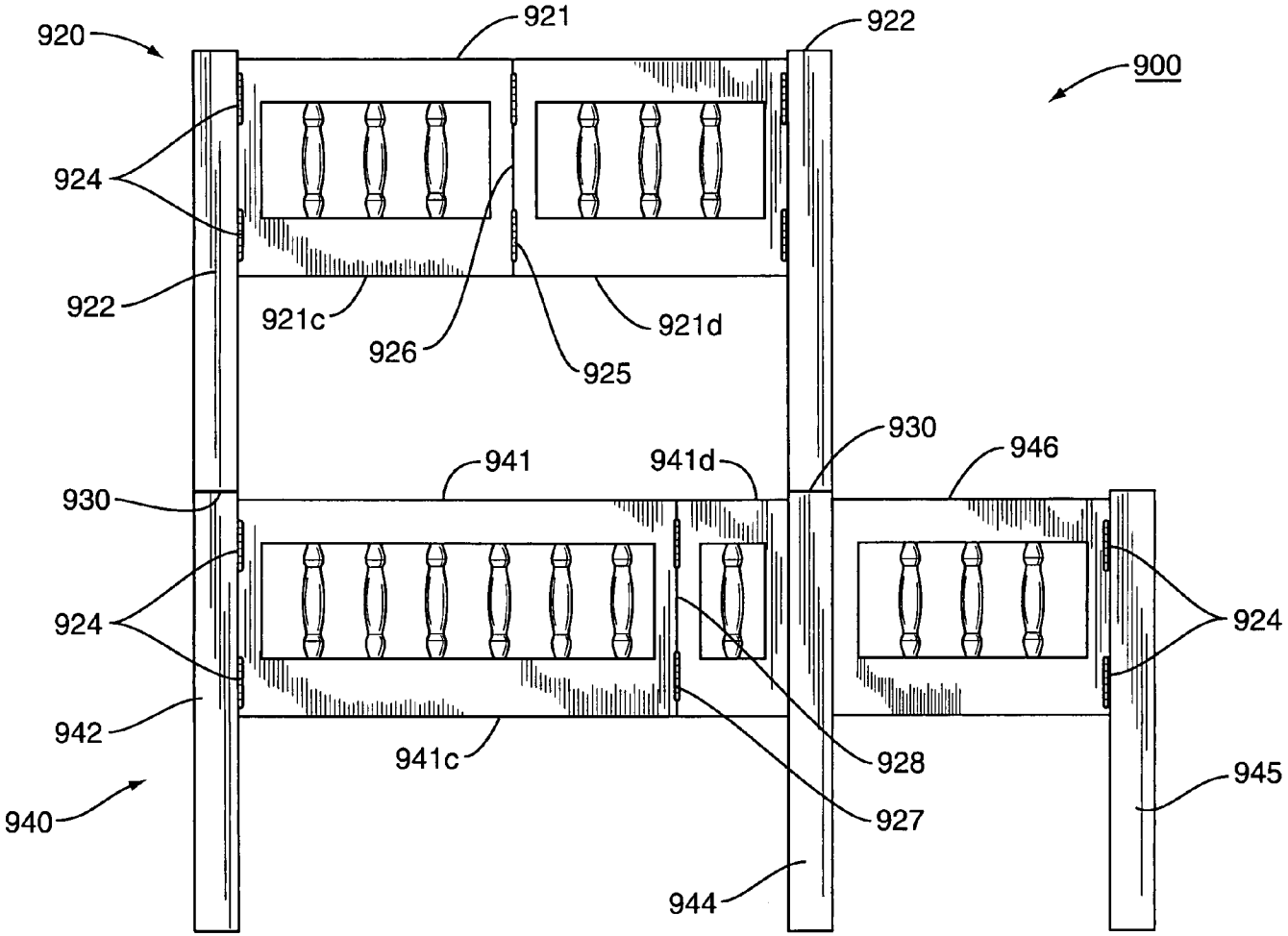
FIG. 9 is an elevational view of an alternative foldable bed frame of the present invention.

Referring now to FIG. 9, an end view of yet another embodiment 900 of a collapsible bed is shown. In this embodiment, the collapsible bed 900 also comprises first and second bed frames 920, 940 one of which is positioned vertically above the other to form the upper bunk bed. However, unlike the embodiments described above, the lower bed frame 940 is larger, similar to a full sized bed frame or larger, than the bunk bed frame 920 stacked thereon. As shown in FIG. 9, the first and second frames 920, 940 are also preferably separable into two individual beds at junction 930. Each frame 920, 940 also comprises a pair of opposed end walls 921 and 941, each of which include a wall portion. Wherein the wall portion of frame 920 has corner members 922 at each opposed end, the wall portion of frame 940 comprises corner members 942 on one side of the frame, intermediate members 944 for mating engagement with the corner members 922 of frame 920, and corner members 945 on the opposite side of the frame 940. Therebetween the intermediate members 944 and corner members 945 are supplemental wall portions 946. Supplemental wall portions 946 may be dimensioned for any desired size bed; e.g., full size, queen, or king. In this embodiment, pins, or dowels (not shown) are also inserted into each of the corner members 942 and 944 to hold the two beds securely together. A pair of opposed side members (not shown), or rails, extend between each of the end walls 921 on the upper frame 920 and members 942 and 945 on the lower frame 940. The end wall portions of end wall 921 are hinged at each of the corner members 922 with hinges 924. As shown in FIG. 9, each of the opposed walls 921 also comprise a pair of panels 921*c*, *d* that are hingedly connected with hinges 925 along a vertical seam 926 in the central portion of the wall portion 921. With respect to frame 940, however, the end wall portions of end walls 941 and 946 are hinged at each of the corner members 942 and 945 with hinges 924. Each of the end walls 941 also comprise a pair of panels 941*c* and 941*d* that are hingedly connected with hinges 927 along a vertical seam 928. As will be appreciated, vertical seam 928 is positioned centrally between corner members 942 and 945 so that the width of the lower frame between corner members 942 and 945 may be equally folded.

Each side member further includes an inturned supporting flange (not shown) along the lower portion thereof. As will again be appreciated, in this embodiment, the opposed walls 921, 941 of the first and second bed frames 920, 940 are not connected as in the first embodiment of FIG. 1 so that the frames may be separated into two individual beds. Again optional removable slats (not shown) may be provided to support a mattress.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A collapsible bunk bed, comprising:

(a) a first and second bed frame, one of which is positioned vertically above the other to form the bunk bed, each of the bed frames comprising:

(i) a pair of opposed end walls having opposed ends, each of which includes a wall portion with a corner member at each opposed end;

(ii) a pair of opposed side members extending between each of the end walls, each side member fixedly connected at each end to corresponding corner members of the opposed end walls;

(iii) the wall portion of each end wall being hinged at each end to the corresponding corner member and being hinged along a vertical seam in the central portion of the wall portion;

(iv) each side member including an inturned supporting flange along the lower portion thereof; and (b) one of the bed frames having the four corner members thereof connected to and supported by the corresponding corner members of the bed frame below.

2. The bunk bed of claim 1 wherein the corner members of the first and second bed frames are separable at a point.

3. The bunk bed of claim 1 wherein the corner members of the first and second bed frames are integrally formed.

4. The bunk bed of claim 3 and further comprising a vertically extending connecting member interconnecting the corresponding wall portions of the first and second bed frames, each connecting member being formed of two parallel parts hingedly connected along the seam therebetween.

5. A collapsible bunk bed, comprising:

(a) a first and second bed frame, one of which is positioned vertically above the other to form the bunk bed:

(b) the first bed frame of a first width comprising:

(i) a pair of opposed end walls, each of which includes a first wall portion and a second wall portion;

(ii) each end wall having a corner member at each opposed end and an intermediate member between the first wall portion and second wall portion;

(iii) a pair of opposed side members extending between each of the end walls, each side member fixedly connected at each end to corresponding corner members of the opposed end walls;

(iv) the first wall portion of each end wall being hinged at one end to the corner member and at the other end to the intermediate member and being hinged along a vertical seam in the central portion thereof;

(v) the seamed wall portion of each end wall being hinged to the intermediate member and fixed to the corresponding corner member;

(vi) each side member including an intumed supporting flange along the lower portion thereof;

(c) the second bed frame of a second width shorter than the first width, comprising:

(i) a pair of opposed end walls, each of which includes a wall portion;

(ii) each end wall having a corner member at each end;

(iii) a pair of opposed side members extending between each of the end walls, each side member fixedly connected at each end to corresponding corner members of the opposed end walls;

(iii) the wall portion of each end wall being hinged at each end to the corresponding corner member and being hinged along a vertical seam in the central portion of the wall portion;

(iv) each side member including an inturned supporting flange along the lower portion thereof; and (d) the second bed frame having the four corner members thereof connected to and supported by two of the corresponding corner members and the two intermediate members of the bed frame below.

* * * * *